US006425661B1

(12) United States Patent
Silverbrook et al.

(10) Patent No.: US 6,425,661 B1
(45) Date of Patent: Jul. 30, 2002

(54) INK CARTRIDGE

(75) Inventors: Kia Silverbrook, Balmain; Tobin Allen King, Cremorne; Garry Raymond Jackson, Haberfield, all of (AU)

(73) Assignee: Silverbrook Research Pty Ltd, Balmain (AU)

( * ) Notice: Subject to any disclaimer, the term of this patent is extended or adjusted under 35 U.S.C. 154(b) by 0 days.

(21) Appl. No.: 09/607,251

(22) Filed: Jun. 30, 2000

(51) Int. Cl.[7] ..... B41J 2/175
(52) U.S. Cl. ..... 347/86
(58) Field of Search ..... 347/85, 86, 87, 347/49

(56) References Cited

U.S. PATENT DOCUMENTS 4,183,031 A * 1/1980 Kyser et al. ..... 347/86
4,973,180 A * 11/1990 Hori ..... 401/141
6,176,633 B1 * 1/2001 Andrews et al. ..... 401/232
6,217,165 B1 * 4/2001 Silverbrook ..... 347/86

FOREIGN PATENT DOCUMENTS

| | | |
|---|---|---|
| JP | 10-235887 | 9/1998 |
| JP | 10-235900 | 9/1998 |
| WO | WO 98/51515 | 11/1998 |

* cited by examiner

*Primary Examiner*—N. Le
*Assistant Examiner*—Michael Nghiem

(57) ABSTRACT

An ink cartridge includes a container defining at least one reservoir in which ink is receivable. An end molding is arranged at a first end of the container. The molding is breached, in use, by a mating formation of a printhead for facilitating flow of ink from the container to the printhead. A seal arrangement is arranged at an opposed end of the container. The seal arrangement includes a pellet of gelatinous material received in each reservoir. The pellet is of a consistency which retains its shape as it is drawn towards the first end of the container as ink is withdrawn from the container, in use.

10 Claims, 5 Drawing Sheets

INK CARTRIDGE

FIELD OF THE INVENTION

This invention relates to an ink cartridge. More particularly, the invention relates to an ink cartridge forming part of a print cartridge to be used in an instantaneous print digital camera.

BACKGROUND OF THE INVENTION

Digital cameras are becoming increasingly popular with consumers for recording images. However, a problem exists with such digital cameras in that, to obtain a hard copy of a print of an image, the digital camera needs to be connected to a computer for printing out the print. The applicant has, in its co-pending U.S. patent application, Ser. No. 09/112,783 filed Jul. 10, 1998 and entitled "Ink and media cartridge with axial ink reservoirs", now U.S. Pat. No. 6,217,165 proposed a replaceable cartridge for such digital cameras.

The digital camera makes use of a page width printhead. By "page width" is meant that the printhead prints one line at a time on the print media without traversing the print media, or rastering, as the print media moves past the printhead.

The cartridge previously disclosed in the applicant's above co-pending U.S. application makes use of an ink cartridge where the reservoirs contain a sponge into which the inks are absorbed.

It is now proposed to provide an ink cartridge with reservoirs containing only ink. In other words, the ink is not absorbed into a sponge but is merely charged into the ink reservoir itself. It is necessary to inhibit drying out of the ink and contamination of the ink while the ink is contained in the reservoirs of the ink cartridge.

SUMMARY OF THE INVENTION

According to a first aspect of the invention, there is provided an ink cartridge for an ink jet print cartridge for use with an ink jet printhead, a mating formation for the ink jet printhead being engageable with the ink cartridge to supply the ink jet printhead with ink, the ink cartridge comprising

- a container defining a number of reservoirs, inks of different colors being receivable in respective reservoirs, the container being mountable within a housing of the print cartridge and the container being shaped so that a roll supply of print media can be positioned about the container;
- a number of seal moldings, one seal molding being positioned at a first end of each reservoir, each seal molding being breached, in use, by the mating formation for facilitating a flow of ink from the container to the printhead; and
- a seal arrangement positioned at an opposed second end of the container, the seal arrangement comprising a number of pellets of a hydrophobic, moldable material received in each respective reservoir, each pellet being of a consistency to retain its shape as each pellet moves towards said first end of its respective reservoir as ink is withdrawn from its respective reservoir, in use.

Each seal molding may be of an elastomeric material that is configured so that said mating formation is insertable through the seal molding to allow ink flow to the printhead. Each seal molding may be hydrophobic.

Each pellet may be self lubricating to be slidable relative to its associated reservoir. The moldable material may be a gelatinous material.

The gelatinous material may be a compound of a polymer and a hydrocarbon which is insertable in a fluent state, when heated, into each of the reservoirs, the material being settable to a gel consistency when it cools.

The polymer may be a copolymer and may be a thermoplastic rubber.

The hydrocarbon may be a mineral oil, more particularly, a white mineral oil.

The second end of each reservoir having the seal arrangement may be closed off by an end cap, the end cap being configured to maintain atmospheric pressure between the seal arrangement and the end cap to facilitate movement of the pellets towards the first end of the container as ink is withdrawn from the container. For this purpose, the end cap may have a plurality of openings, one in fluid communication with each reservoir.

According to a second aspect of the invention, there is provided an ink jet print cartridge for an ink jet printhead, the ink jet print cartridge being engageable with a mating formation for the ink jet printhead to supply the ink jet printhead with ink, the ink jet print cartridge comprising

- a housing;
- a supply roll of print media positioned in the housing;
- a roller feed assembly that is mounted in the housing to feed the print media from the supply roll, the roller feed assembly being driveable externally of the housing; and
- an ink cartridge that is receivable in the housing, the ink cartridge comprising
  - a container defining a number of reservoirs, inks of different colors being receivable in respective reservoirs, the container being mounted within the housing with the supply roll of print media being rotatably positioned about the container;
  - a number of seal moldings, one seal molding being positioned at a first end of each reservoir, each seal molding being configured to be breached, in use, by the mating formation for facilitating a flow of ink from the container to the printhead; and
  - a seal arrangement positioned at an opposed second end of the container, the seal arrangement comprising a number of pellets of a hydrophobic, moldable material, one pellet being received in each respective reservoir, each pellet being of a consistency to retain its shape as each pellet moves towards said first end of the container as ink is withdrawn from its respective reservoir, in use.

BRIEF DESCRIPTION OF THE DRAWINGS

The invention is now described by way of example with reference to the accompanying diagrammatic drawings in which.

DETAILED DESCRIPTION OF THE DRAWINGS

Figure 1:
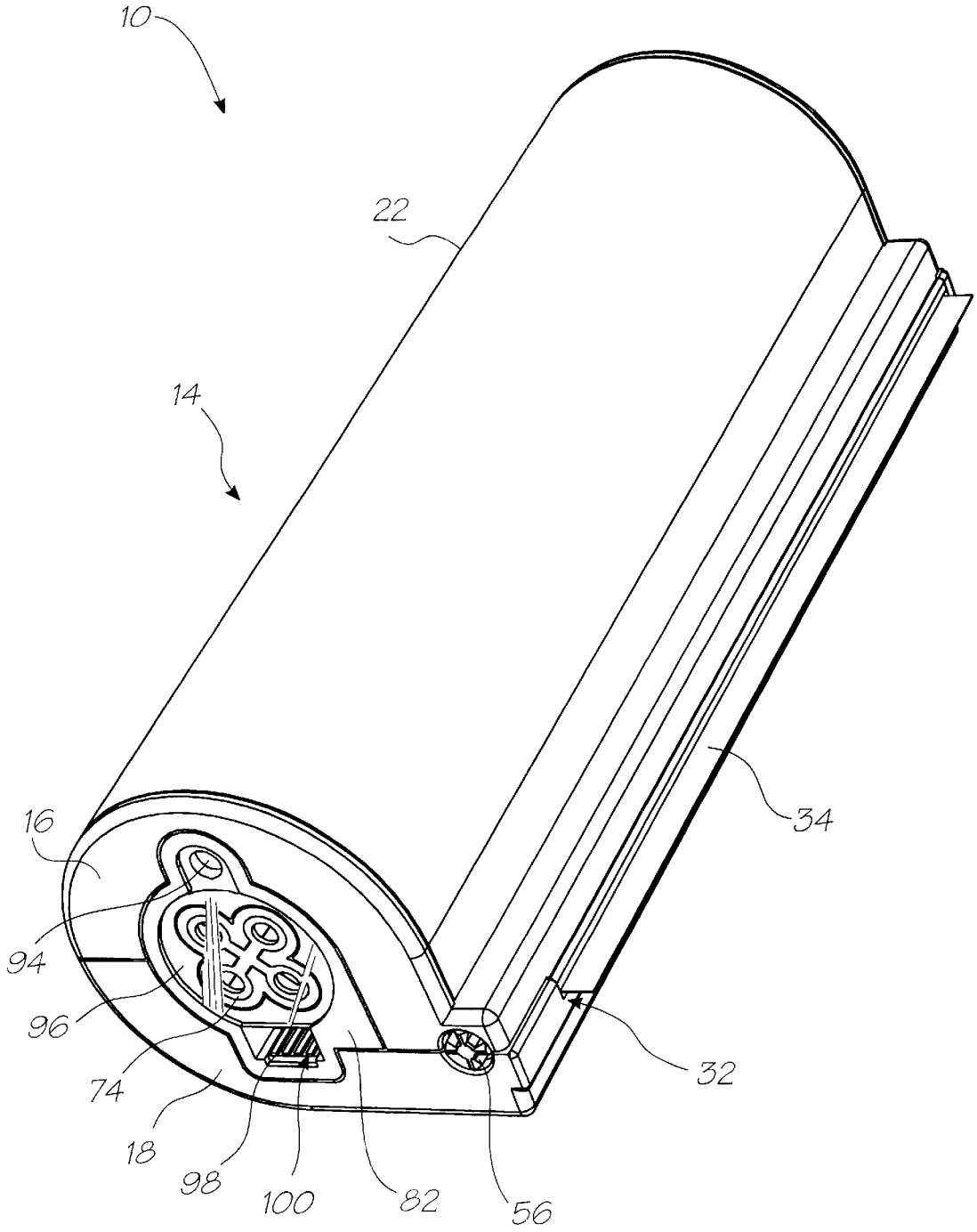
FIG. 1 shows a three dimensional view of a print cartridge.

In the drawings, reference numeral 10 generally designates a print cartridge 10, in accordance with the invention.

The print cartridge 10 includes an ink cartridge 12, also in accordance with the invention.

The print cartridge 10 includes a housing 14. As illustrated more clearly in FIG. 2 of the drawings, the housing 14 is defined by an upper molding 16 and a lower molding 18. The moldings 16 and 18 clip together by means of clips 20. The housing 14 is covered by a label 22 which provides an attractive appearance to the cartridge 10. The label 22 also carries information to enable a user to use the cartridge 10.

The housing 14 defines a chamber 24 in which the ink cartridge 12 is received. The ink cartridge 12 is fixedly supported in the chamber 24 of the housing 14.

A supply of print media 26 comprising a roll of film/media 34 wound about a former 28 is received in the chamber 24 of the housing 14. The former 28 is slidably received over the ink cartridge 12 and is rotatable relative thereto.

Figure 2:
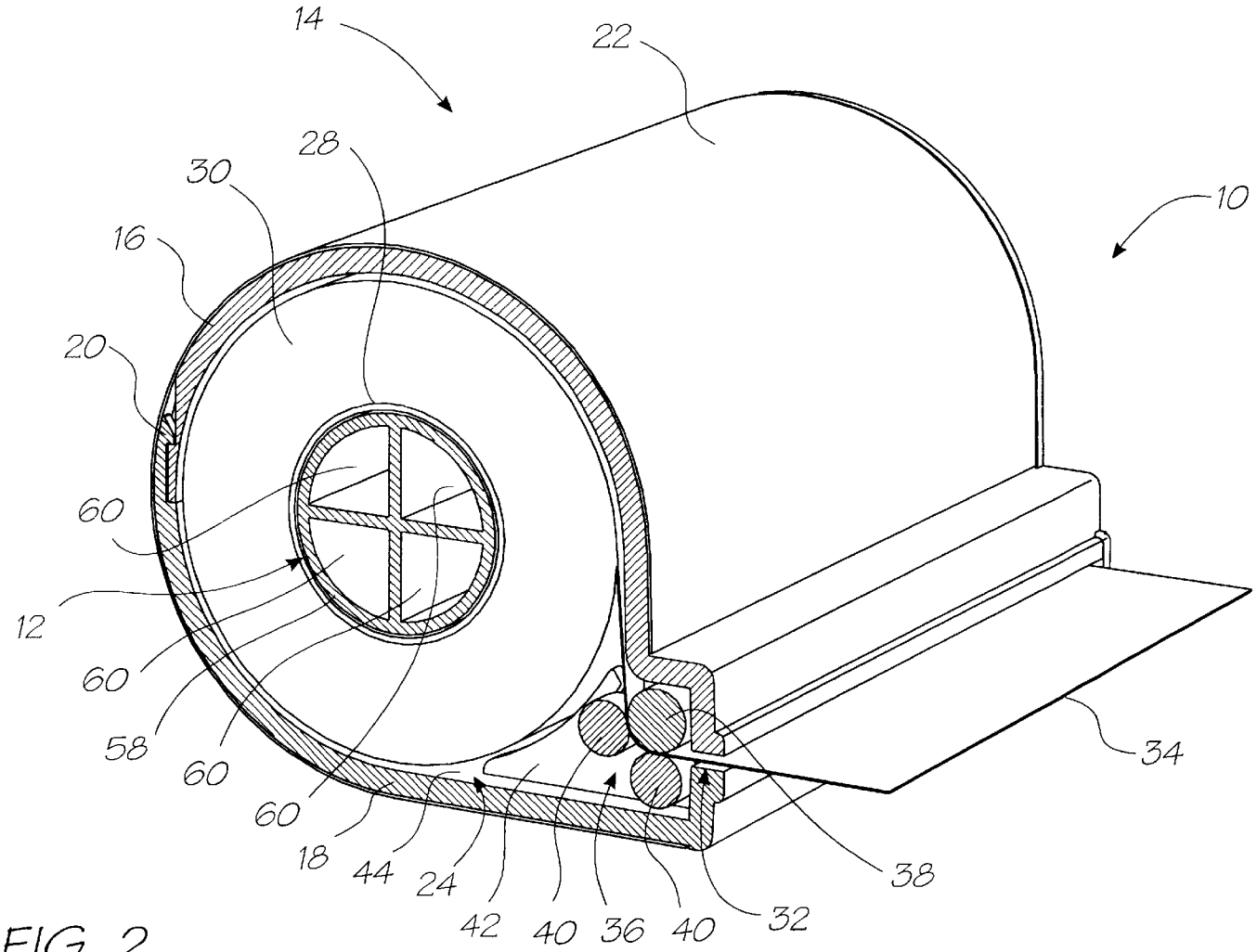
FIG. 2 shows a three dimensional, sectional view of the print cartridge.

As illustrated in FIG. 2 of the drawings, when the upper molding 16 and lower molding 18 are clipped together, an exit slot 32 is defined through which a tongue of the paper 34 is ejected.

The cartridge 10 includes a roller assembly 36 which serves to de-curl the paper 34 as it is fed from the roll 30 and also to drive the paper 34 through the slot 32. The roller assembly 36 includes a drive roller 38 and two driven rollers 40. The driven rollers 40 are rotatably supported in ribs 42 which stand proud of a floor 44 of the lower molding 18 of the housing 14. The rollers 40, together with the drive roller 38, provide positive traction to the paper 34 to control its speed and position as it is ejected from the housing 14. The rollers 40 are injection moldings of a suitable synthetic plastics material such as polystyrene. In this regard also, the upper molding 16 and the lower molding 18 are injection moldings of suitable synthetic plastics material, such as polystyrene.

The drive roller 38 includes a drive shaft 46 which is held rotatably captive between mating recesses 48 and 50 defined in a side wall of each of the upper molding 16 and the lower molding 18, respectively, of the housing 14. An opposed end 52 of the drive roller 38 is held rotatably in suitable formations (not shown) in the upper molding 16 and the lower molding 18 of the housing 14.

The drive roller 38 is a two shot injection molding comprising the shaft 46 which is of a high impact polystyrene and on which are molded a bearing means in the form of elastomeric or rubber roller portions 54. These portions 54 positively engage the paper 34 and inhibit slippage of the paper 34 as the paper 34 is fed from the cartridge 10.

The end of the roller 38 projecting from the housing 14 has an engaging formation in the form of a cruciform arrangement 56 (FIG. 1) which mates with a geared drive interface (not shown) of a printhead assembly of a device, such as a camera, in which the print cartridge 10 is installed. This arrangement ensures that the speed at which the paper 34 is fed to the printhead is synchronised with printing by the printhead to ensure accurate registration of ink on the paper 34.

The ink cartridge 12 includes a container 58 which is in the form of a right circular cylindrical extrusion. The container 58 is extruded from a suitable synthetic plastics material such as polystyrene.

In a preferred embodiment of the invention, the printhead with which the print cartridge 10 is used, is a multi-colored printhead. Accordingly, the container 58 is divided into a plurality of, more particularly, four compartments or reservoirs 60. Each reservoir 60 houses a different color or type of ink. In one embodiment, the inks contained in the reservoirs 60 are cyan, magenta, yellow and black inks. In another embodiment of the invention, three different colored inks, being cyan, magenta and yellow inks, are accommodated in three of the reservoirs 60 while a fourth reservoir 60 houses an ink which is visible in the infra-red light spectrum only.

Figure 3:
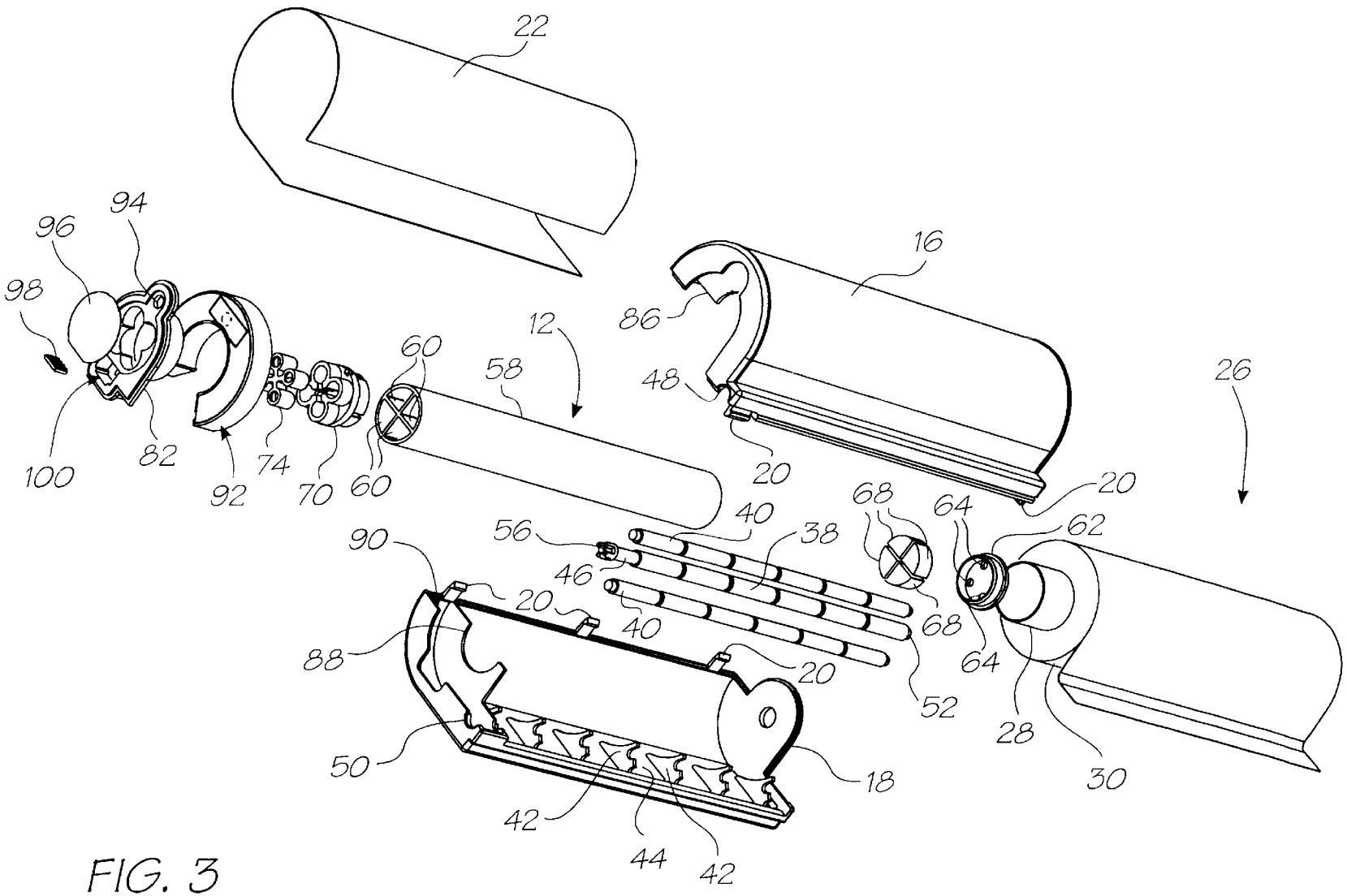
FIG. 3 shows a three dimensional, exploded view of the print cartridge.
Figure 4:
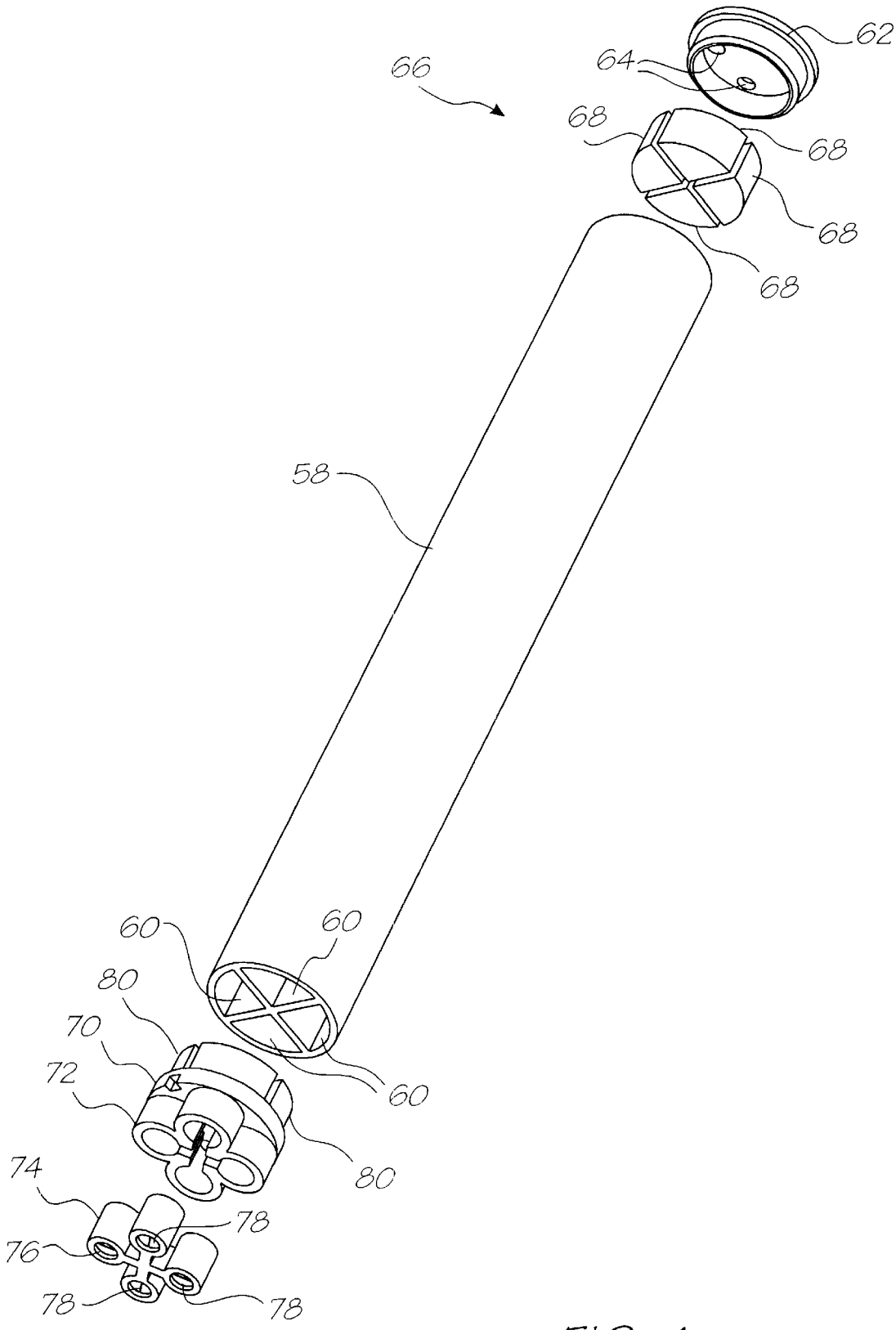
FIG. 4 shows a three dimensional, exploded view of an ink cartridge, in accordance with the invention, forming part of the print cartridge.

As shown more clearly in FIGS. 3 and 4 of the drawings, one end of the container 58 is closed off by an end cap 62. The end cap 62 has a plurality of openings 64 defined in it. An opening 64 is associated with each reservoir 60 so that atmospheric pressure is maintained in the reservoir 60 at that end of the container 58 having the end cap 62.

A seal arrangement 66 is received in the container 58 at the end having the end cap 62. The seal arrangement 66 comprises a quadrant shaped pellet 68 of gelatinous material slidably received in each reservoir 60. The gelatinous material of the pellet 68 is a compound made of a thermoplastic rubber and a hydrocarbon. The hydrocarbon is a white mineral oil. The thermoplastic rubber is a copolymer which imparts sufficient rigidity to the mineral oil so that the pellet 68 retains its form at normal operating temperatures while permitting sliding of the pellet 68 within its associated reservoir 60. A suitable thermoplastic rubber is that sold under the registered trademark of "Kraton" by the Shell Chemical Company. The copolymer is present in the compound in an amount sufficient to impart a gel-like consistency to each pellet 68. Typically, the copolymer, depending on the type used, would be present in an amount of approximately three percent to twenty percent by mass.

In use, the compound is heated so that it becomes fluid. Once each reservoir 60 has been charged with its particular type of ink, the compound, in a molten state, is poured into each reservoir 60 where the compound is allowed to set to form the pellet 68. Atmospheric pressure behind the pellets 68, that is, at that end of the pellet 68 facing the end cap 62 ensures that, as ink is withdrawn from the reservoir 60, the pellets 68, which are self-lubricating, slide towards an opposed end of the container 58. The pellets 68 stop ink emptying out of the container when inverted, inhibit contamination of the ink in the reservoir 60 and also inhibit drying out of the ink in the reservoir 60. The pellets 68 are hydrophobic further to inhibit leakage of ink from the reservoirs 60.

The opposed end of the container 58 is closed off by an ink collar molding 70. Baffles 72 carried on the molding 70 receive an elastomeric seal molding 74. The elastomeric seal molding 74, which is hydrophobic, has sealing curtains 76 defined therein. Each sealing curtain 76 has a slit 78 so that a mating pin (not shown) from the printhead assembly is insertable through the slits 78 into fluid communication with the reservoirs 60 of the container 58. Hollow bosses 80 project from an opposed side of the ink collar molding 70. Each boss 80 is shaped to fit snugly in its associated reservoir 60 for locating the ink collar molding on the end of the container 58.

Reverting again to FIG. 3 of the drawings, the ink collar molding 70 is retained in place by means of a carrier or fascia molding 82. The fascia molding 82 has a four leaf clover shaped window defined therein through which the elastomeric seal molding 74 is accessible. The fascia molding 82 is held captive between the upper molding 16 and the lower molding 18 of the housing 14. The fascia molding $\mu$and webs 86 and 88 extending from an interior surface of the upper molding 16 and the lower molding 18 respectively, of the housing 14 define a compartment 90. An air filter 92 is received in the compartment 90 and is retained in place by the end molding 82. The air filter 92 cooperates with the printhead assembly. Air is blown across a nozzle guard of a printhead assembly to effect cleaning of the nozzle guard. This air is filtered by being drawn through the air filter 92 by means of a pin (not shown) which is received in an inlet opening 94 in the fascia molding 82.

Figure 5:
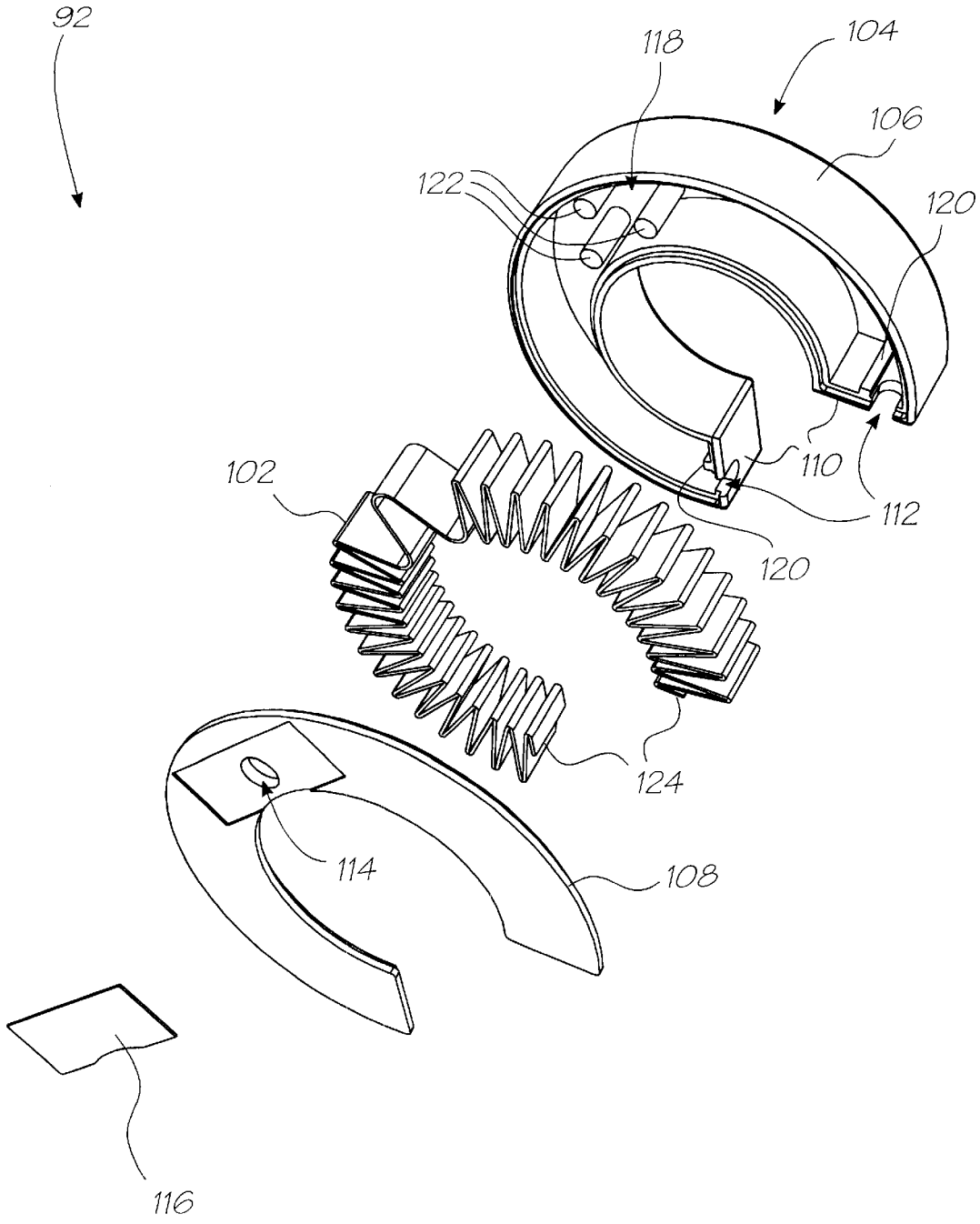
FIG. 5 shows a three dimensional view of an air filter of the print cartridge.

The air filter 92 is shown in greater detail in FIG. 5 of the drawings. The air filter 92 comprises a filter medium 102. The filter medium 102 is synthetic fibre based and is arranged in a fluted form to increase the surface area available for filtering purposes. Instead of a paper based filter medium 102 other fibrous batts could also be used.

The filter medium 102 is received in a canister 104. The canister 104 includes a base molding 106 and a lid 108. To be accommodated in the compartment 90 of the housing 14, the canister 104 is part-annular or horse shoe shaped. Thus, the canister 104 has a pair of opposed ends 110. An air inlet opening 112 is defined in each end 110.

An air outlet opening 114 is defined in the lid 108. The air outlet opening, initially, is closed off by a film or membrane 116. When the filter 92 is mounted in position in the compartment 90, the air outlet opening 114 is in register with the opening 94 in the fascia molding 82. The pin from the printhead assembly pierces the film 116 then draws air from the atmosphere through the air filter 92 prior to the air being blown over the nozzle guard and the printhead of the printhead assembly.

The base molding 104 includes locating formation 118 and 120 for locating the filter medium 102 in position in the canister 104. The locating formations 118 are in the form of a plurality of pins 122 while the locating formations 120 are in the form of ribs which engage ends 124 of the filter medium 102.

Once the filter medium 102 has been placed in position in the base mold 106, the lid 108 is secured to the base molding 106 by ultrasonic welding or similar means to seal the lid 108 to the base molding 106.

When the print cartridge 10 has been assembled, a membrane or film 96 is applied to an outer end of the fascia molding 82 to close off the window 84. This membrane or film 96 is pierced or ruptured by the pins, for use. The film 96 inhibits the ingress of detritus into the ink reservoirs 60.

An authentication means in the form of an authentication chip 98 is received in an opening 100 in the fascia molding 82. The authentication chip 98 is interrogated by the printhead assembly 98 to ensure that the print cartridge 10 is compatible and compliant with the printhead assembly of the device.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

We claim:

1. An ink cartridge for an ink jet print cartridge for use with an ink jet printhead, a mating formation for the ink jet printhead being engageable with the ink cartridge to supply the ink jet printhead with ink, the ink cartridge comprising a container defining a number of reservoirs, inks of different colors being receivable in respective reservoirs, the container being mountable within a housing of the print cartridge and the container being shaped so that a roll supply of print media can be positioned about the container;

a number of seal moldings, one seal molding being positioned at a first end of each reservoir, each seal molding being configured to be breached, in use, by the mating formation for facilitating a flow of ink from the container to the printhead; and a seal arrangement positioned at an opposed second end of the container, the seal arrangement comprising a number of pellets of a hydrophobic, moldable material, one pellet being received in each respective reservoir, each pellet being of a consistency to retain its shape as each pellet moves towards said first end of its respective reservoir as ink is withdrawn from its respective reservoir, in use.

2. The ink cartridge of claim 1 in which each seal molding is in the form of an elastomeric seal molding, which is configured so that said mating formation is insertable through the seal molding to allow ink flow to the printhead.

3. The ink cartridge of claim 2 in which the seal molding is hydrophobic.

4. The ink cartridge of claim 1 in which the moldable material of each pellet is a gelatinous material.

5. The ink cartridge of claim 4 in which the gelatinous material is self-lubricating so that each pellet is slidable within its respective reservoir.

6. The ink cartridge of claim 5 in which the gelatinous material is a compound of a polymer and a hydrocarbon which is insertable in a fluent state, when heated, into each reservoir, the material being settable to a gel consistency when it cools.

7. The ink cartridge of claim 6 in which the polymer is a thermoplastic rubber.

8. The ink cartridge of claim 6 in which the hydrocarbon is a mineral oil.

9. The ink cartridge of claim 1 in which the second end of each reservoir is closed off by an end cap, the end cap being configured to maintain atmospheric pressure between the seal arrangement and the end cap.

10. An ink jet print cartridge for an ink jet printhead, the ink jet print cartridge being engageable with a mating formation for the ink jet printhead to supply the ink jet printhead with ink, the ink jet print cartridge comprising a housing;

a supply roll of print media positioned in the housing;

a roller feed assembly that is mounted in the housing to feed the print media from the supply roll, the roller feed assembly being driveable externally of the housing; and an ink cartridge that is receivable in the housing, the ink cartridge comprising a container defining a number of reservoirs, inks of different colors being receivable in respective reservoirs, the container being mounted within the housing with the supply roll of print media being rotatably positioned about the container;

a number of seal moldings, one seal molding being positioned at a first end of each reservoir, each seal molding being configured to be breached, in use, by the mating formation for facilitating a flow of ink from the container to the printhead; and a seal arrangement positioned at an opposed second end of the container, the seal arrangement comprising a number of pellets of a hydrophobic, moldable material, one pellet being received in each respective reservoir, each pellet being of a consistency to retain its shape as each pellet moves towards said first end of the container as ink is withdrawn from its respective reservoir, in use.

* * * * *